US005551216A

United States Patent [19]

McGill

[11] Patent Number: 5,551,216

[45] Date of Patent: Sep. 3, 1996

[54] METHOD AND APPARATUS FOR FILLING A BALL GRID ARRAY

[75] Inventor: Scott D. McGill, Tucson, Ariz.

[73] Assignee: Vanguard Automation, Inc., Tucson, Ariz.

[21] Appl. No.: 504,521

[22] Filed: Jul. 20, 1995

Related U.S. Application Data

[63] Continuation-in-part of Ser. No. 306,144, Sep. 14, 1994, Pat. No. 5,499,487.

[51] Int. Cl.[6] ..... B65B 5/10

[52] U.S. Cl. ..... 53/473; 53/246; 53/539

[58] Field of Search ..... 53/473, 475, 539, 53/246, 251, 250, 249, 247, 244, 263, 255, 235

[56] References Cited

U.S. PATENT DOCUMENTS

| | | | |
|---|---|---|---|
| 2,613,861 | 10/1952 | Goerlitz | 53/246 X |
| 3,298,404 | 1/1967 | Eisenberg | 53/473 X |
| 3,696,581 | 10/1972 | Eisenberg | 53/473 X |
| 3,789,575 | 2/1974 | Bross | 53/539 X |
| 4,546,594 | 10/1985 | Mohaupt | 53/473 X |

*Primary Examiner*—James F. Coan
*Attorney, Agent, or Firm*—Herbert M. Shapiro

[57] ABSTRACT

A work cell for populating a ball grid array employs gravity for transferring solder balls from a tooling plate to the ball grid array. The tooling plate is positioned on a gantry along with a reservoir for solder balls. The gantry, along with the tooling plate and reservoir, is rotated through about one hundred and eighty degrees to spread the solder balls over the tooling plate and to recapture loose solder balls as the gantry rotates. A riser cylinder moves a ball grid array into juxtaposition with the populated tooling plate prior to the point (i.e. angle of rotation) at which gravity operates to drop the solder balls out of the tooling plate. Further rotation results in gravity transfer of the solder balls to a (fluxed) ball grid array. Apparatus employing more than one work cell is also described.

11 Claims, 9 Drawing Sheets

METHOD AND APPARATUS FOR FILLING A BALL GRID ARRAY

RELATED APPLICATIONS

The present application is a continuation in part of copending application Ser. No. 08/306,144 filed Sep. 14, 1994, now U.S. Pat. No. 5,499,487, for the inventor of the present application and assigned to the assignee of the present application.

FILED OF THE INVENTION

This invention relates to ball grid arrays and more particularly to the placement of solder balls in such arrays.

BACKGROUND OF THE INVENTION

Ball grid arrays are well known in the art and available commercially. Such an array comprises a plastic film with an array of recesses, each recess providing a receptacle for a solder ball. The arrays are available in strips and the individual segments of the strip (i.e. array) can be detached from the strip.

The task of populating the recesses reliably is a difficult one and a number of procedures to accomplish reliable solder ball placement have been devised. One such procedure developed by Motorola, employs a vacuum chuck with a number of holes corresponding to the recesses in a ball grid array. The holes are defined in a shift plate which moves to release the ball into the ball grid array, properly positioned, when the vacuum is removed. Another method employs a "dip strip" which captures the balls and then mates the ball grid array to the "dip strip" to transfer the balls.

The above noted copending application discloses an alternative method for populating a ball grid array. The method employs gravity for transferring solder balls from a tooling plate to an awaiting ball grid array, positioned closely beneath the plate. The tooling plate and the ball grid array are fastened to a rotatable gantry or wheel. The wheel is rotated to move the pair of components, tooling plate down, through a reservoir of solder balls. The wheel is rotated further so that the tooling plate is positioned above the ball grid array for gravity transfer of the solder balls.

BRIEF DESCRIPTION OF ILLUSTRATIVE EMBODIMENTS OF THE INVENTION

In accordance with he principle of this invention, gravity again is employed to transfer solder balls from a tooling plate to a closely positioned ball grid array. Further, the tooling plate is moved with respect to a reservoir of solder balls for populating the tooling plate with solder balls for later transfer to the ball grid array. But in one embodiment herein, the reservoir geometry is such as to capture loose solder balls during a one hundred and eighty degrees rotation of the reservoir and both the reservoir and the fixture carrying the tooling plate and the ball grid array actually rotate through about one hundred and eighty degrees.

The balls in the reservoir spread across the tooling plate at one range of positions during the rotation sequence to populate the tooling plate. As the gantry, to which the reservoir, the tooling plate and the ball grid array are attached, rotates further, a riser cylinder is activated to move the ball grid array into close proximity to the tooling plate. As further rotation occurs, the tooling plate moves above the ball grid array for gravity transfer. The gantry oscillates over about a one hundred and eighty to two hundred degree angle so that solder balls do not escape the reservoir.

DETAILED DESCRIPTION OF ILLUSTRATIVE EMBODIMENTS OF THIS INVENTION

Figure 1:
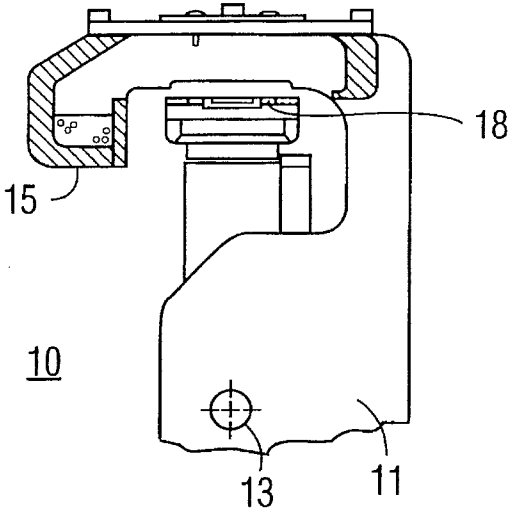
FIG. 1 through 12 are schematic side views of a solder ball placement work cell in accordance with the principles of this invention showing the orientation of the various components therin during operation.

FIG. 1 shows a schematic side view of a work cell 10 in accordance with the principles of this invention. The work cell includes a gantry 11 rotatable about on axis 13. The gantry includes a reservoir 15 to the top of which (as viewed in the figure) a tooling plate 16 and a backing plate 17 are secured.

A ball grid array 18 is spaced apart from but aligned with the tooling plate. The ball grid array is positioned on riser cylinder 19 operative like a solenoid to move the ball grid array into juxtaposition with the tooling plate controllably. The riser cylinder, the ball grid array, the tooling plate and the reservoir are all affixed to the gantry and rotatable through first, second and third stages of orientations as the gantry moves through about one hundred and eighty to two hundred degrees of rotation.

Figure 2:
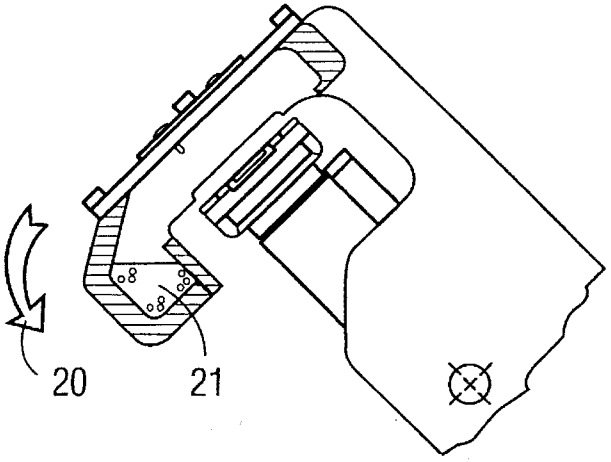
Figure 3:
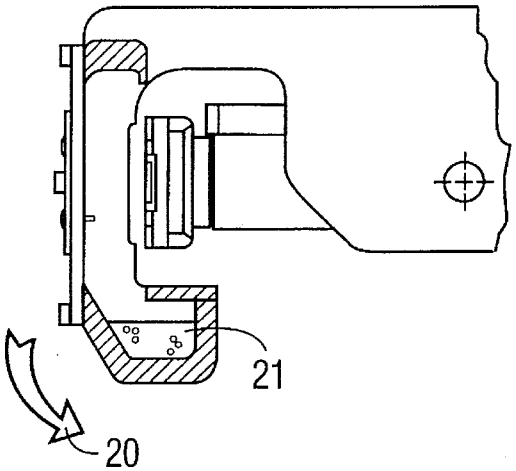
Figure 6:
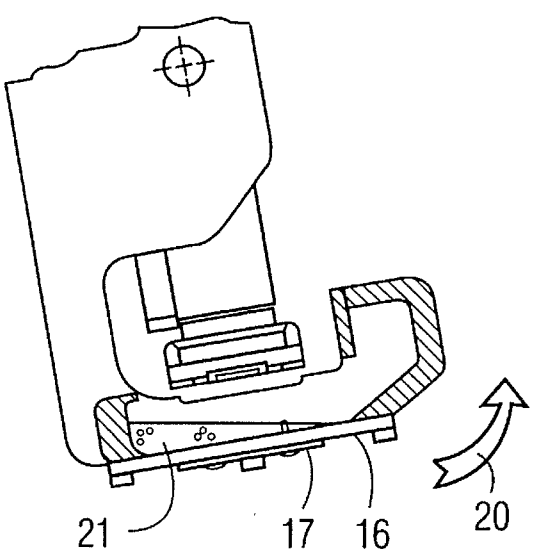
Figure 5:
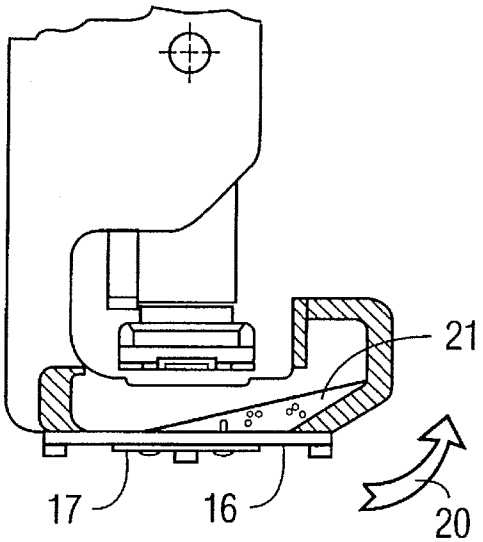
Figure 4:
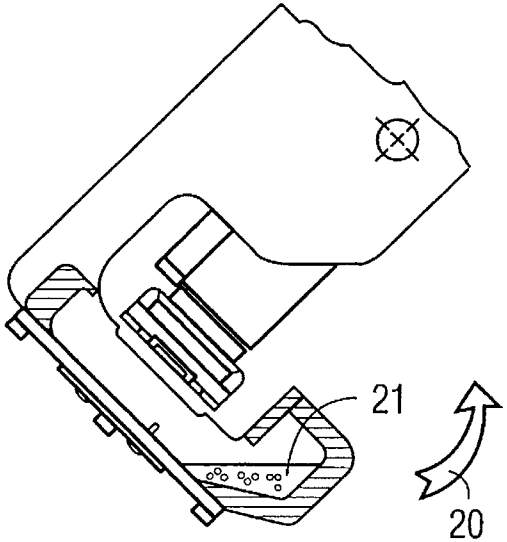

The rotation of the gantry and the operation of the various components herein are described in connection with FIGS. 2 though 12. The rotation initially is counterclockwise as indicated by arrows 20 in the figures. The solder balls, 21, can be seen to assume different profiles as the gantry rotates to a 45 degree orientation as shown in FIG. 2, and to a 90 degree, a 135 degree, a 180 degree to 200 degree orientation as shown in FIGS. 3,4,5 and 6 respectively. The operation as shown in FIGS. 1 through 6, spreads the folder balls in the reservoir across the tooling plate as shown in FIGS. 5 and 6.

Figure 8:
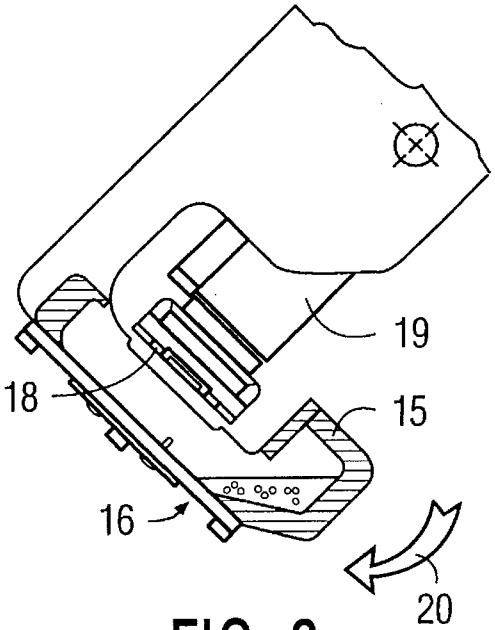
Figure 7:
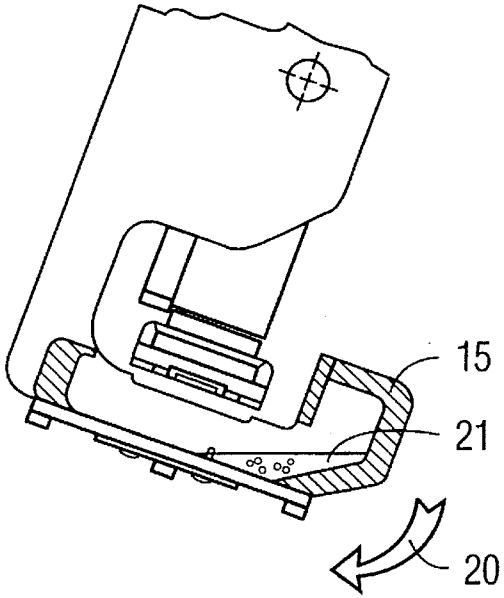

The direction of rotation now reverses as shown by arrows 20 in FIGS. 7 through 11. Specifically, the gantry now moves clockwise collecting loose solder balls in the reservoir as the gantry moves to the 160 degree orientation as shown in FIG. 7. The populated tooling plate moves to an orientation where all loose solder balls have fallen free of the tooling plate as shown in FIG. 8.

Figure 9:
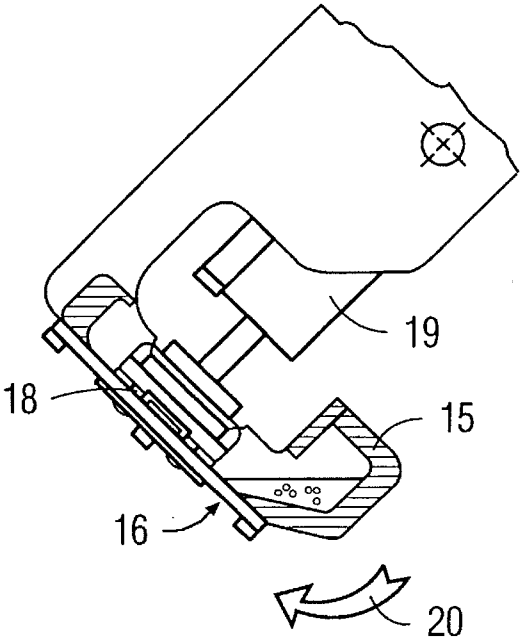
Figure 11:
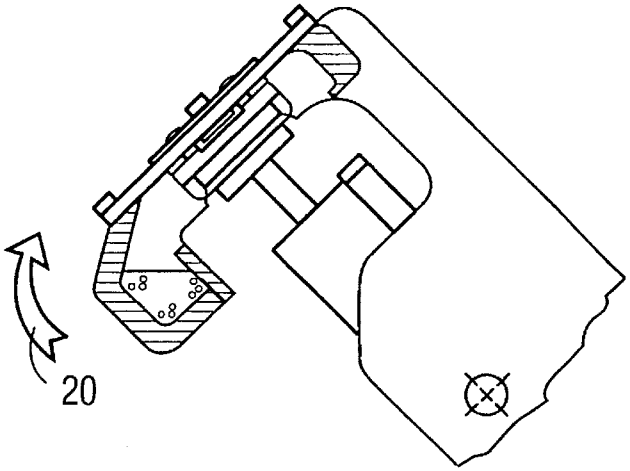
Figure 10:
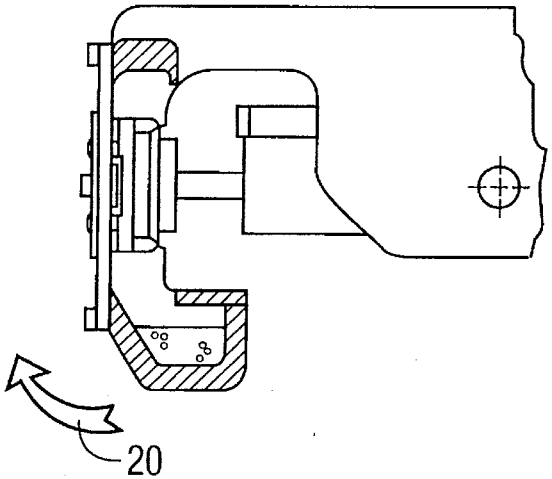

The gantry now is entering a range of orientations where riser cylinder 19 is operative to move the ball grid array into juxtaposition with the tooling plate as shown in FIG. 9. Further rotation occurs, as shown in FIG. 10, where gravity begins to become operative. FIG. 11 shows the gantry rotated into the range where gravity is operative to drop solder balls from the tooling plate to the awaiting (and aligned) ball grid array.

Figure 12:
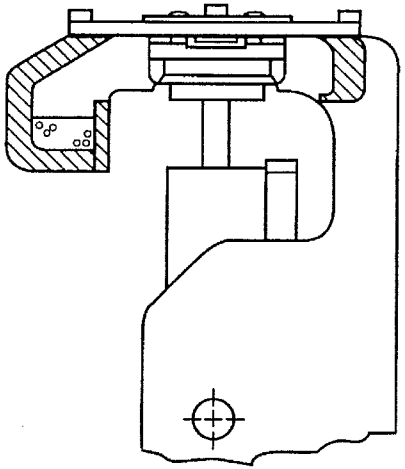

FIG. 12 shows the rotation (or oscillation) cycle to be completed and the gantry is returned to the position shown for it in FIG. 1.

The operation depicted in FIGS. 1 through 12 can be seen to be divided into several operations: The first is the solder ball spill operation to populate the tooling plate. This operation occurs during a first range of gantry orientations depicted in FIGS. 1 through 6. The second operation is the movement of the ball grid array into close proximity to the now populate tooling plate. This operation occurs when the gantry is reoriented through a second range of orientations depicted in FIGS. 7 through 10. The third operation occurs when the gantry is rotated through a third range of orientations depicted in FIGS. 11 and 12 where gravity is operative to transfer the solder balls from the tooling plate to the ball grid array.

Figure 13:
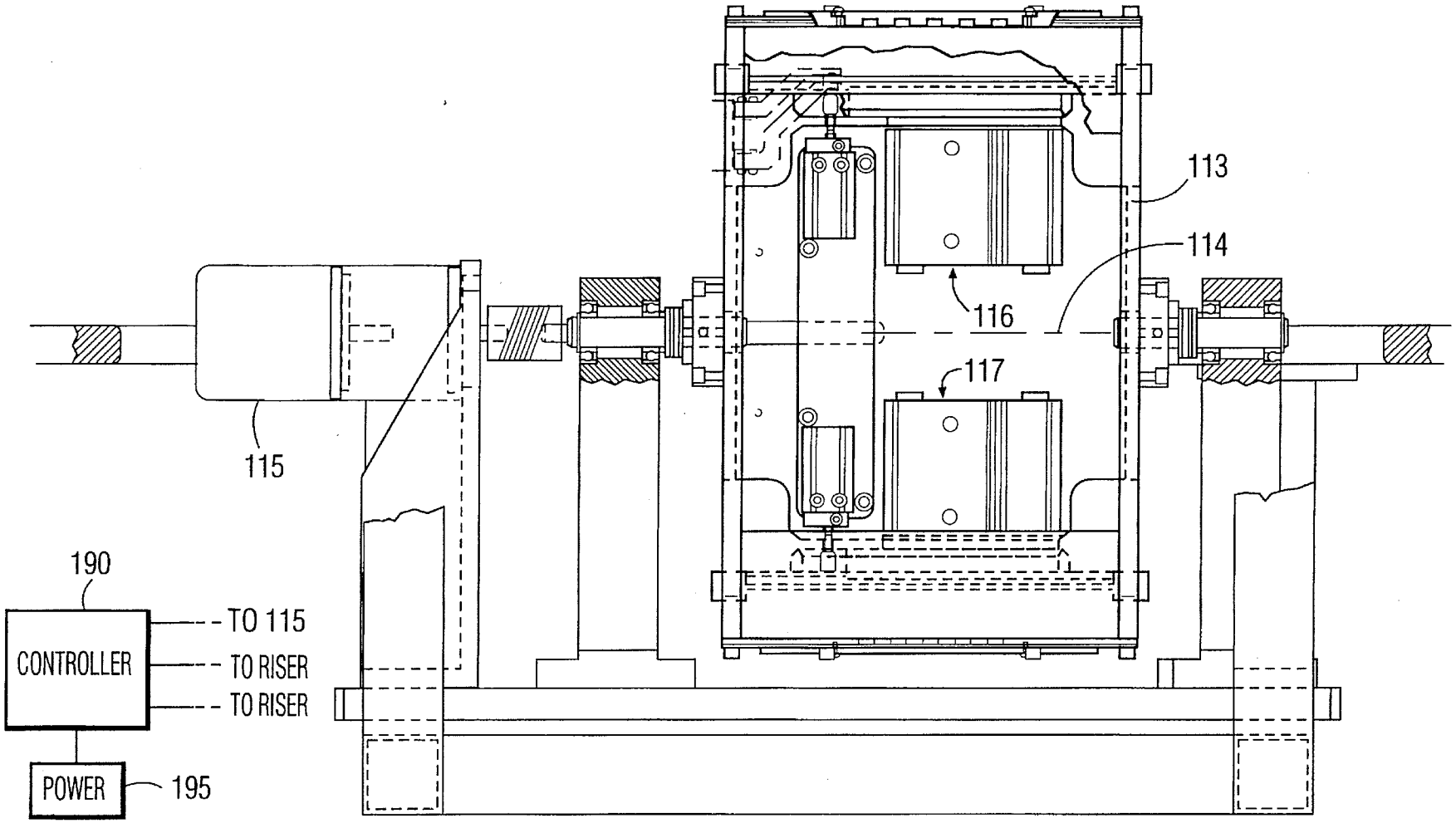
FIGS. 13, 14 and 15 are schematic end, side and top views of a practical embodiment in accordance with the principle of this invention.
Figure 14:
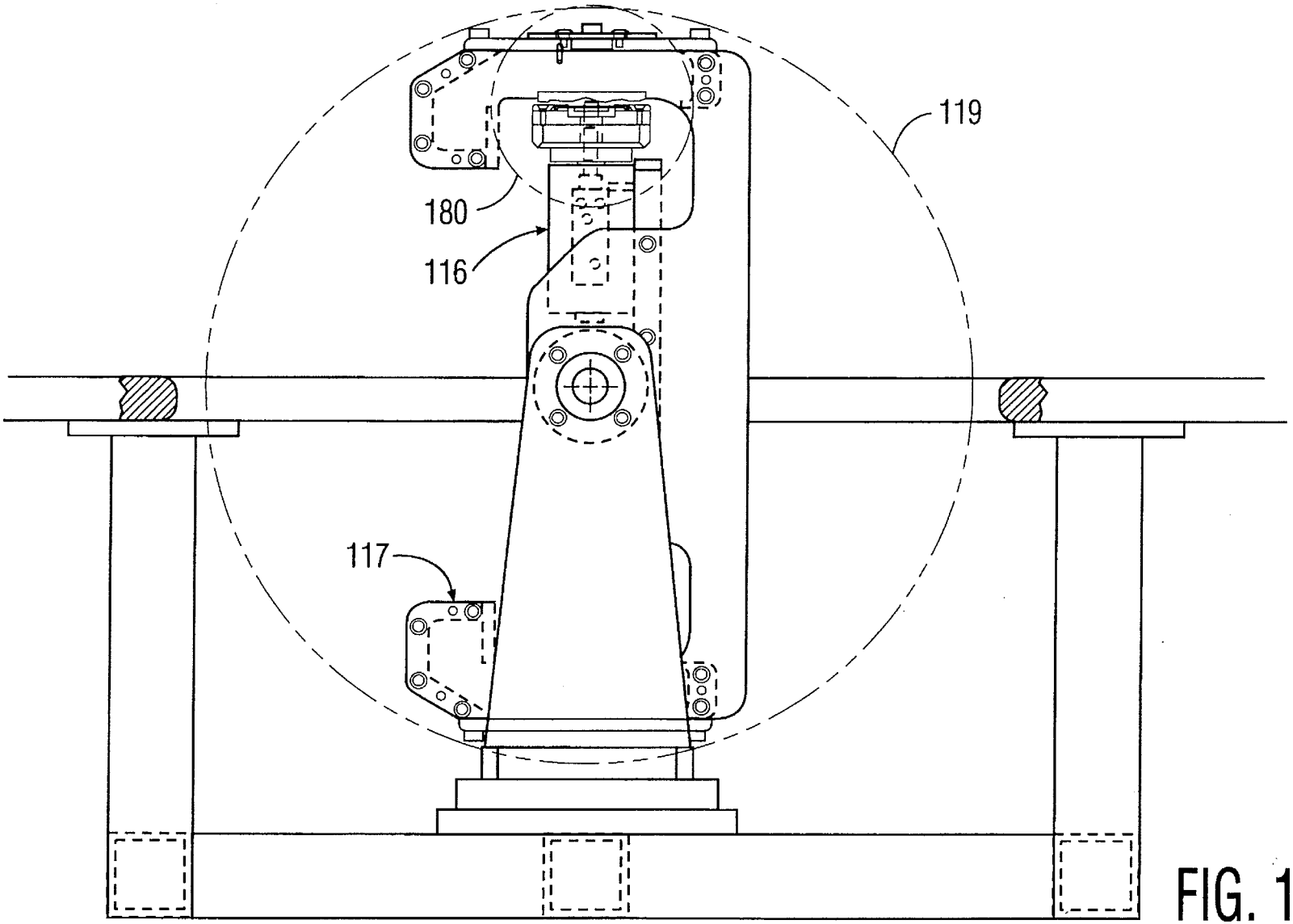

FIGS. 13 and 14 show schematic side and top views of apparatus for implementing the invention shown in FIG. 1 through 12. FIG. 13 shows a gantry 113 rotatable about axis 114 via motor 115. First and second work cells 116 and 117 are secured to the gantry at the top and at the bottom as viewed in FIG. 13. Each of the work cells is as depicted in FIGS. 1 through 12. In operating, the work cells are rotated, as described hereinbefore, along a circular path designated 119 in FIG. 14. The use of two work cells permits a doubling of the throughput of the apparatus, one of the work cells always being readied for ball placement while the solder balls are being transferred to the ball grid array in the other work cell.

Figure 15:
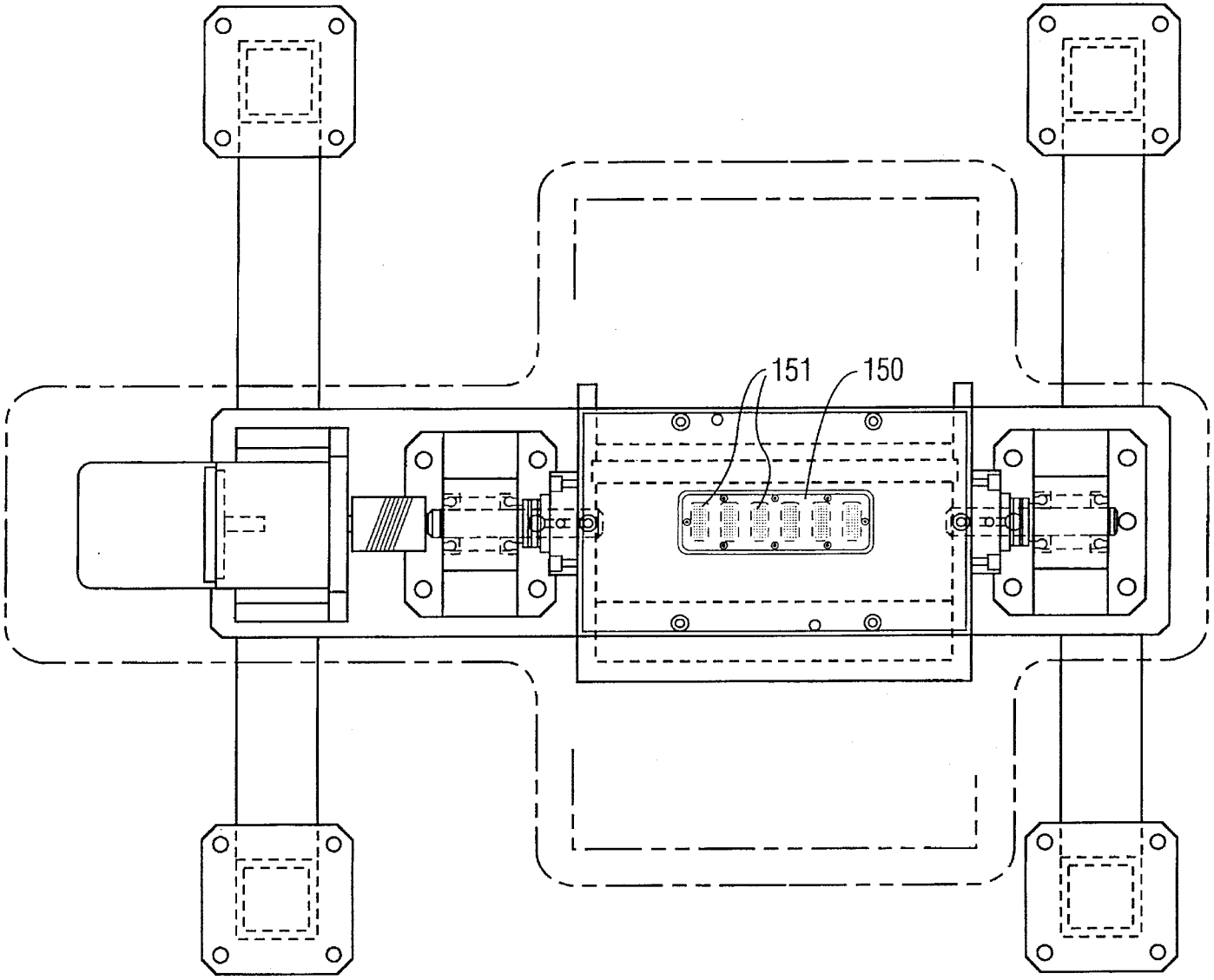
Figure 16:
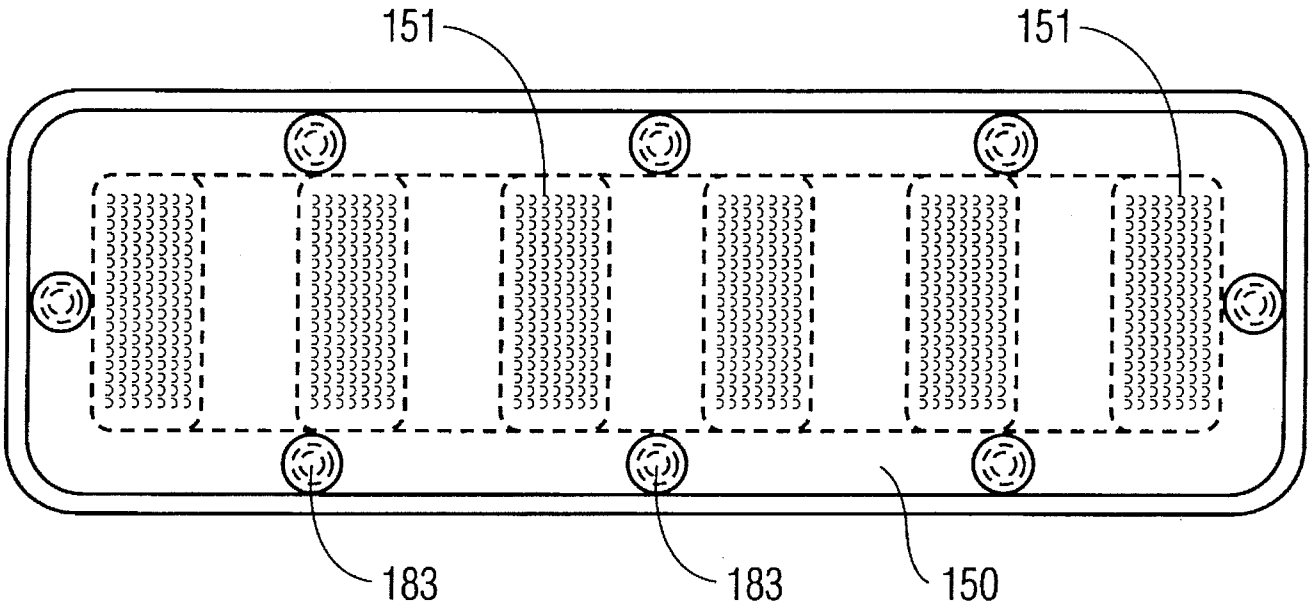
FIGS. 16 through 18 are enlarged schematic representations of portions of the embodiment of FIGS. 13, 14 and 15.

FIG. 15 shows a top view of work cell 116 of FIG. 13. The figures shows an array pattern of holes in the tooling plate receiving solder balls during the operation depicted in FIGS. 1 through 12. FIG. 16 shows the pattern enlarged. The tooling plate is designated 150 in FIGS. 15 and 16 and the hole pattern is designated 151.

Figure 17:
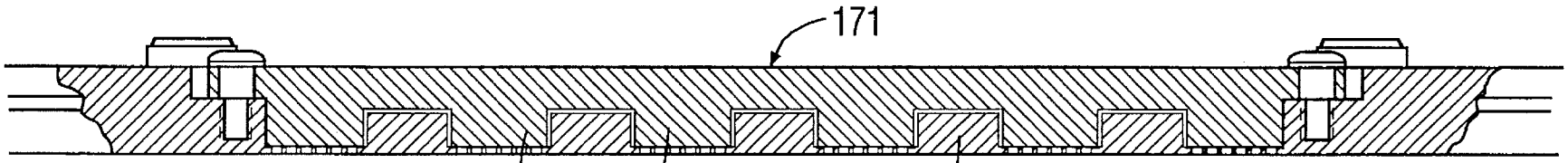

FIG. 17 shows enlarged, the tooling plate 170 and backing plate 17 1. The tooling plate has an array of solder ball pockets 173 for receiving the solder ball during the operation of FIGS. 4 through 7.

Figure 18:
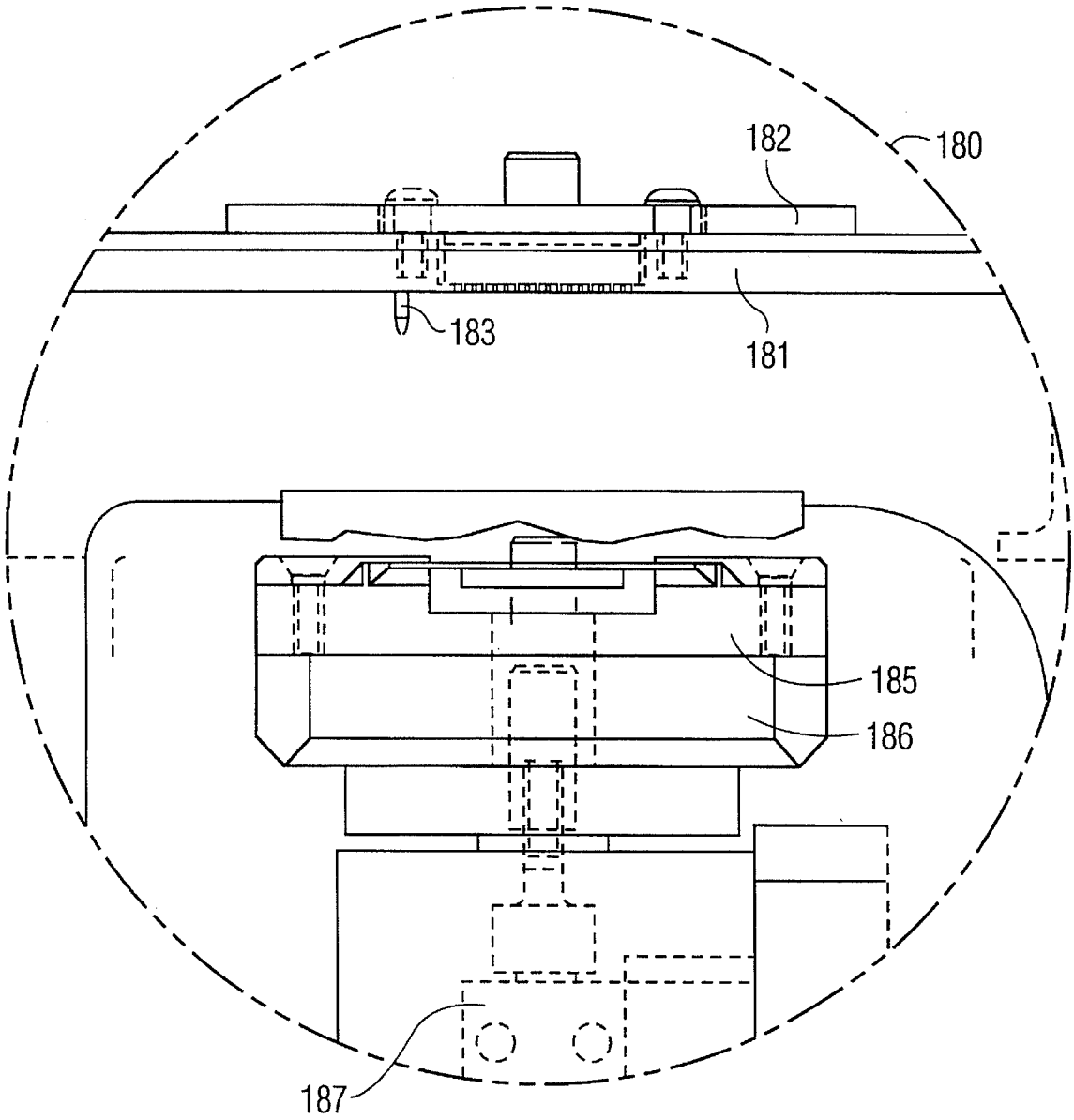

FIG. 18 shows enlarged the area of FIG. 14 encircled by broken line 180. The figure shows the tooling plate 181 and the backing plate 182 where the tooling plate has an array pattern as shown in FIG. 16. The tooling plate also has a number of alignment pins 183 shown also in FIG. 16.

The ball grid array is mounted on the riser cylinder as discussed hereinbefore. The ball grid array is designated 185 and is positioned in a nesting plate, in practice, for handling and alignment. The nesting plate mates with the riser cylinder mounting plate 186. The riser cylinder moves the mounting plate and thus the ball grid array into juxtaposition with the tooling plate as shown in FIG. 9.

As is common practice with ball grid arrays, the arrays are coated with a flux which is an adhesive to retain the solder balls in place. The adhesive is coated onto ball grid array strips in a silk screening process prior to positioning the ball grid array in the work cell. One adhesive used in practice is, illustratively, a Chester Corporation - SP291 which is a resin based material with actuators which is heated to between 100 and 120 degrees Fahrenheit before application.

The apparatus may be any size so long as it accepts ball grid array strips and in the prototype stage had dimensions of about one by one and one half feet.

The operation is controlled by controller 190, as shown in FIG. 13, responsive to user input. Outputs of the controller are connected to inputs to motor 115 and to riser cylinder (19 of FIG. 1 through 12) for providing timing control and power from a power source 195. When first and second work cells are affixed to opposite ends of the gantry as shown in FIG. 13, the controller is operative to activate the riser cylinder in each work cell at the appropriate time in the third range of orientations for that work cell.

What is claimed is:

1. A method of filling a ball grid array with solder balls in a first work cell including a tooling plate, a ball grid array, a riser cylinder and reservoir, said method comprising the steps of aligning said ball grid array with said tooling plate, said tooling plate having an array of holes for receiving solder balls, rotating said ball grid array, said tooling plate and a reservoir of solder balls through a first range of orientations such that loose solder balls spread over said tooling plate for populating said array of holes therein, activating said riser cylinder for moving said ball grid array into juxtaposition with said tooling plate during a second range of orientations in which loose solder balls are recaptured in said reservoir and rotating said ball grid array and said tooling plate through a third range of orientations during which gravity is operative to transfer the solder balls to a like array of holes in said ball grid array.

2. A method as in claim 1, said method including the steps of attaching said first work cell and a like second work cell to opposite ends of a gantry, rotating said gantry such that said first and second work cell reorient through first, second, and third ranges of orientations at different times, activating a riser cylinder of said first and second work cells during the associated and different second ranges for affecting gravity transfer of solder balls from each tooling plate to the associated ball grid array during the associated and different third range of orientations.

3. Apparatus for filling a ball grid array, said apparatus comprising a reservoir for solder balls and a tooling plate with an array of holes for receiving solder balls, said apparatus including a gantry rotatable about an axis, said tooling plate and said reservoir being attached to said gantry and rotatable with the gantry about said axis, said reservoir being of a geometry to hold loose solder balls during said rotation and to spill said solder balls across said tooling plate during a first range of orientations of said gantry, said apparatus also including a fixture for securing a ball grid array to said gantry, said fixture being aligned with said tooling plate, said fixture including a riser cylinder for moving said ball grid array into juxtaposition with said tooling plate during a second range of orientations of said gantry for later transfer of said solder balls from said tooling plate to said juxtaposed ball grid array when said gantry later moves through a third range of orientation.

4. Apparatus is in claim 1 wherein said reservoir has a geometry to contain said solder balls over about a 200 degree rotation of said gantry.

5. Apparatus as in claim 4 wherein said tooling plate is affixed to said reservoir in a position exposed to the movement of solder balls in said reservoir during said 200 degree rotating of said gantry.

6. Apparatus as in claim 5 including a controller for rotating said gantry from a reference orientation to between 185 degrees and 200 degrees in a first direction and back to said reference orientation.

7. Apparatus as in claim 6 wherein said controller is operative to activate said riser cylinder during said third range of orientations when said gantry is being rotating back to said reference position.

8. Apparatus as in claim 7 including first and second work cells affixed to said gantry, each of said work cells including a reservoir, a ball grid array and a tooling plate, said first and second work cell also including first and second riser cylinders respectively, said controller being operative to activate said first and second riser cylinders during a third range for each of said first and second work cells.

9. Apparatus as in claim 8 wherein said tooling plate for each of said work cells is nested into the bottom of the reservoir of the respective work cell.

10. Apparatus as in claim 9 wherein said reservoir of each of said work cell includes an aperture for receiving and positioning a tooling plate.

11. A work cell for transferring solder balls from a reservoir of solder balls to a ball grid array, said work cell comprising a gantry rotatable about an axis, a solder ball reservoir said reservoir being adapted for holding loose solder balls and also being affixed to said gantry and rotatable therewith through first, second, and third ranges of orientations of said gantry, said work cell also including a tooling plate also affixed to said gantry and rotatable therewith, said apparatus also including a ball grid array also affixed to said gantry, said ball grid array being spaced apart from and aligned with said tooling plate and rotatable with said gantry, said tooling plate and said reservoir being positioned for spreading solder balls from said reservoir onto said tooling plate during said first range of orientations, said apparatus also including a riser cylinder for moving said ball grid array into juxtaposition with said tooling plate during said second range of orientations, said ball grid array and said tooling plate bring positioned for gravity transfer of solder balls to said ball grid array during said third range of orientations of said gantry.

* * * * *